United States Patent [19]

Olivieri

[11] Patent Number: 4,767,127

[45] **Date of Patent: * Aug. 30, 1988**

[54] ROLLER SKATE WITH A BINDING STRAP FITTING FROM THE REAR

[75] Inventor: Oliviero Olivieri, Montebelluna, Italy

[73] Assignee: Icaro Olivier & C. S.p.A., Montebelluna, Italy

[ * ] Notice: The portion of the term of this patent subsequent to Jan. 12, 2005 has been disclaimed.

[21] Appl. No.: 881,317

[22] Filed: Jul. 2, 1986

[30] Foreign Application Priority Data

Jul. 2, 1985 [IT] Italy ..... 21397 A/85

[51] Int. Cl.[4] ..... A63C 1/18

[52] U.S. Cl. ..... 280/11.33; 24/68 CD

[58] Field of Search ..... 280/11.19, 11.27, 11.3, 280/11.31, 621, 11.33; 24/68 CD, 68 T, 273

[56] References Cited

U.S. PATENT DOCUMENTS

| | | | |
|---|---|---|---|
| 31,280 | 1/1861 | Gibbs | 280/11.3 |
| 283,915 | 8/1883 | Morris | 280/11.27 |
| 2,271,452 | 1/1942 | Carroll | 280/621 |
| 3,693,988 | 9/1972 | Steinhiser | 280/11.31 X |
| 4,468,045 | 8/1984 | Sarazen | 280/11.3 |

*Primary Examiner*—John J. Love
*Assistant Examiner*—Michael Mar
*Attorney, Agent, or Firm*—Sughrue, Mion, Zinn, Macpeak & Seas

[57] ABSTRACT

For binding this roller skate, a strap is provided which extends arcuately across the skate frame and fits from the rear; the strap has juxtaposed end portions associated adjustably with the frame. A pull force is applied removably to the end portions of the strap for tightening the strap on the foot.

15 Claims, 12 Drawing Sheets

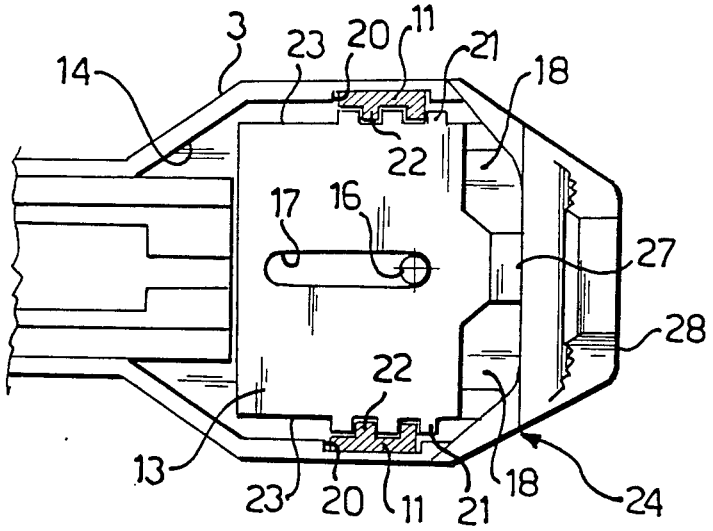
Fig-2
Fig-3
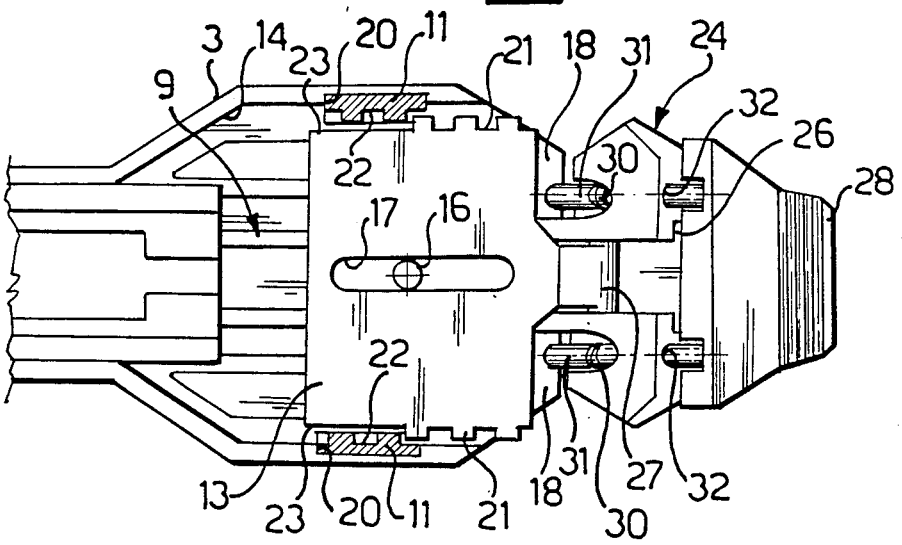

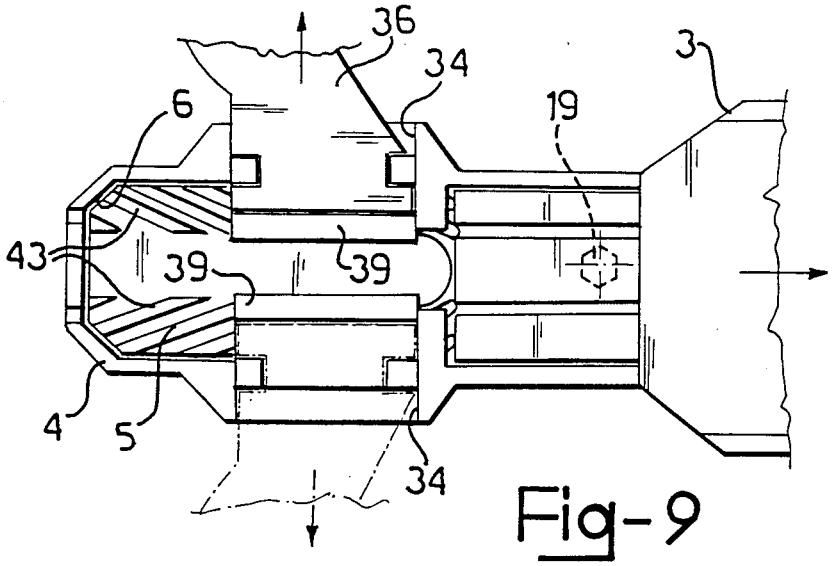
Fig-9
Fig-10
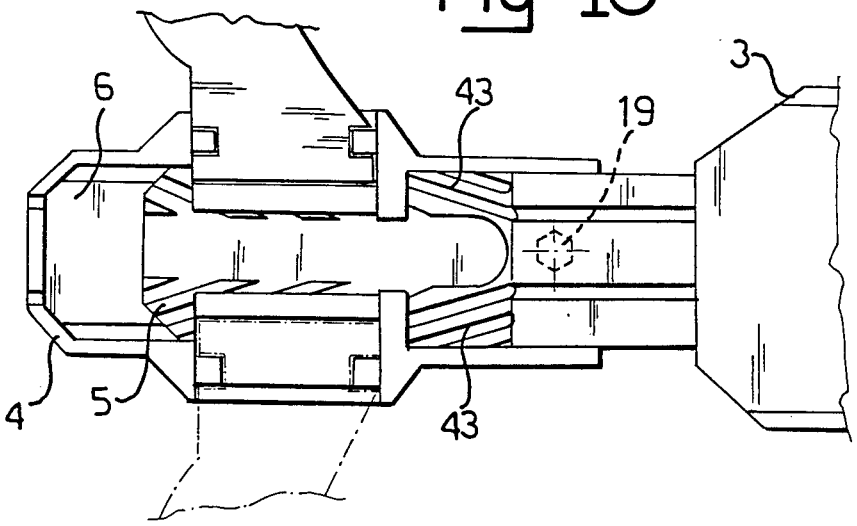

ROLLER SKATE WITH A BINDING STRAP FITTING FROM THE REAR

DESCRIPTION

1. Technical Field

The present invention relates to a roller skate with a binding device for releasably securing a shod foot to a skate frame.

2. Background Art

Roller skates, and especially those intended for recreational non-athletic use, are adapted for removable fastening to user's footwear.

To that end, known roller skates are provided with binding devices of various description generally including a strap.

These skates comprise a frame, mostly extendible to fit different footwear sizes, to which respective straps are attached at the toe and ankle of the user's foot which tighten the foot down against the frame and rearward against a specially provided vertical back wall, the so-called heel-piece. Each strap is split into two half-straps respectively attached to the frame on right-hand and left-hand sides, one half-strap is hooked to the other, and concurrently tightened, by means of buckle devices, or other tightening devices.

The skates of the type just described are not devoid of drawbacks, especially as relates to their convenience, ease of securement and tightening firmness. In fact to fasten a skate on, one must first unfasten the straps, rest a foot on the skate, fasten the straps, tighten and adjust them finding the most appropriate tension therefor. All these operations must be repeated each time that the skate is put on, because on releasing the skate, the previously found adjustment is lost. Then, the inconvenient tensioning procedure reflects unavoidably on its effectiveness.

One to these well-recognized drawbacks, known skates are not invariably satisfactory and a skater usually chooses skates having the piece of footwear formed integrally with the skate or permanently attached thereto.

DISCLOSURE OF INVENTION

It is an object of the present invention to provide a roller skate mainly for recreational use of the type intended for attachment to a piece of footwear, which can nevertheless meet the requirements for convenience and secure binding from highly demanding users, and in particular affords retention of the tension adjustment after release.

That object is achieved, according to the invention, by a roller skate of the aforesaid type, characterized in that it comprises a strap arranged arcuately across the frame and adapted for rear fitting, said strap having end portions adjustably associated with the frame, a tensioning means on said frame for applying a pull force to said strap end portions, to thereby tighten the strap on the foot, and releasable locking means for retaining the tensioned condition of said strap.

BRIEF DESCRIPTION OF DRAWINGS

FIGS. 2 and 3 are fragmentary plan views of the rear portion of the skate of FIG. 1, in two different operational conditions thereof;

FIGS. 9 and 10 are two fragmentary plan views of the forward portion of the skate of FIG. 1, in two different operational conditions thereof;

BEST MODE FOR CARRYING OUT THE INVENTION

Figure 1:
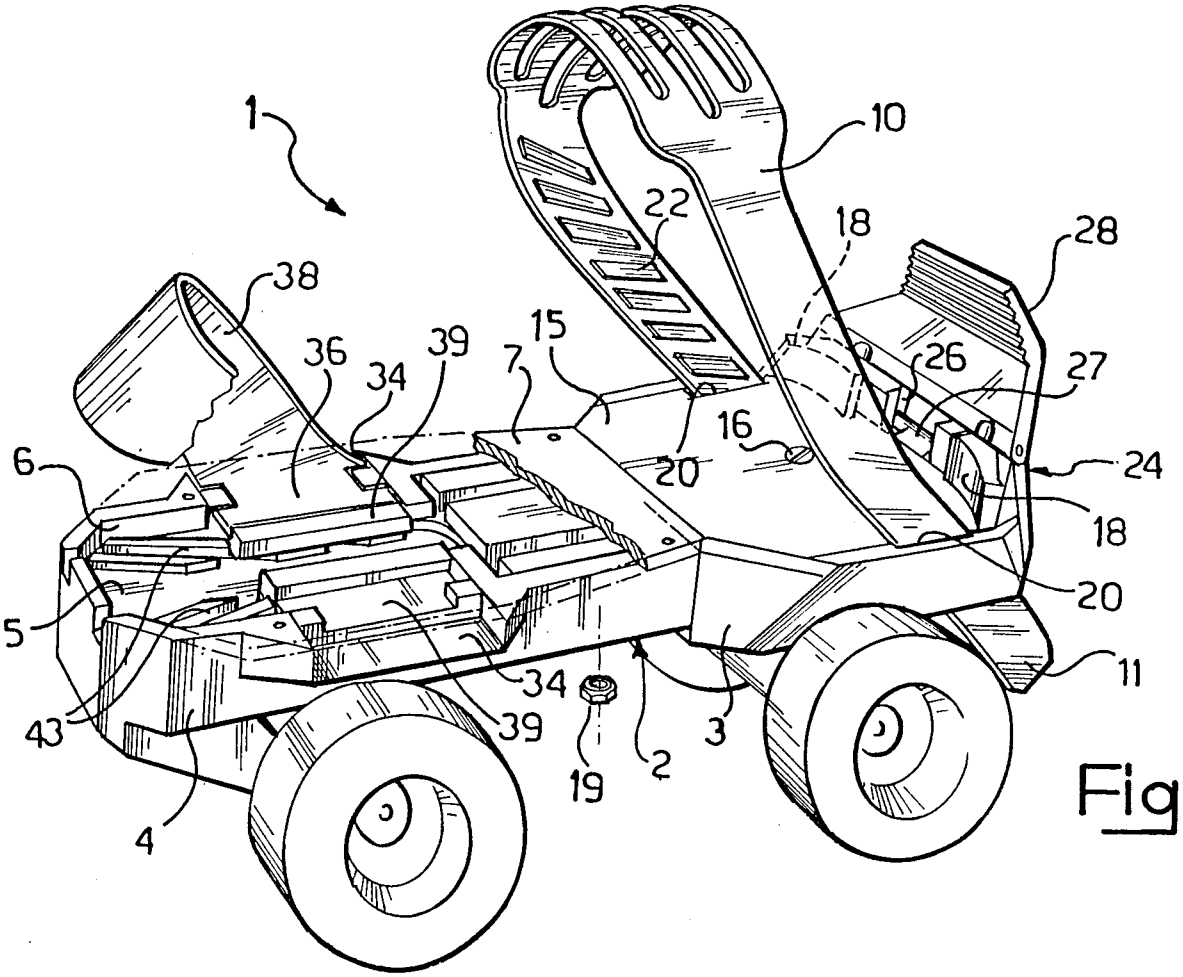
FIG. 1 is a part-sectional perspective view of a skate according to the invention.
Figure 4:
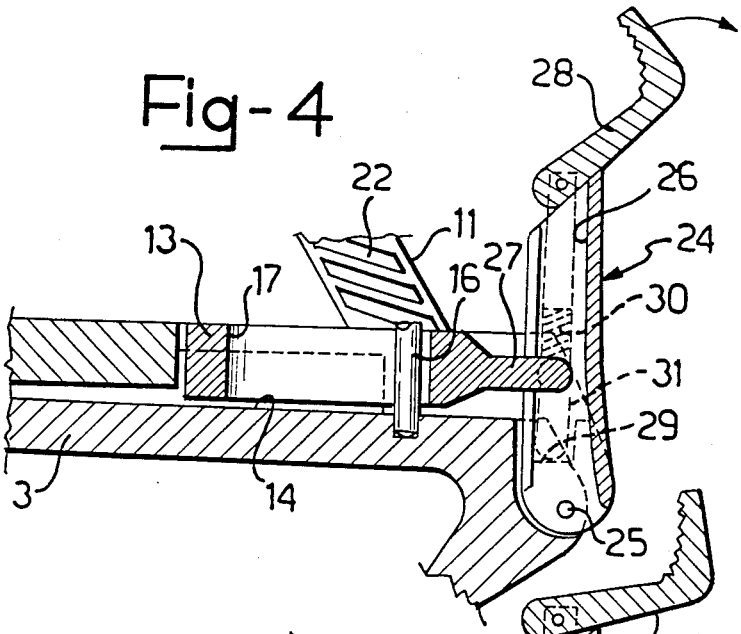
FIGS. 4,5,6 are fragmentary sectional views of the rear portion of the skate of FIG. 2, in three different operational conditions thereof.
Figure 5:
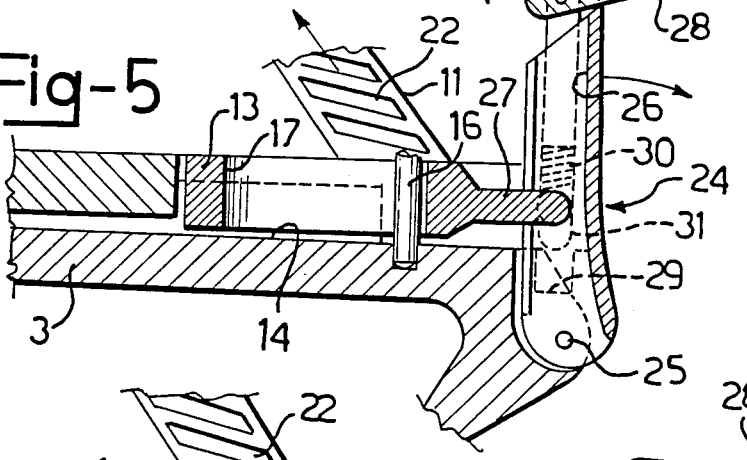
Figure 6:
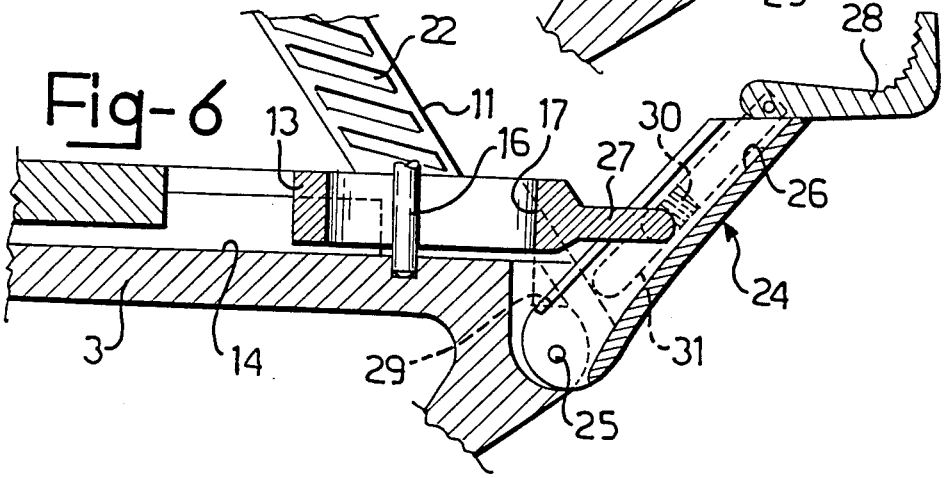
Figure 7:
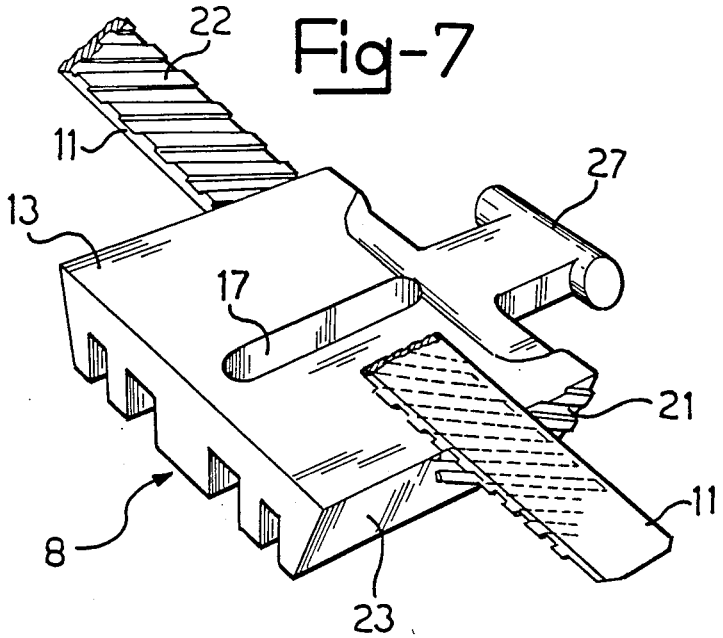
FIG. 7 is a perspective view of a detail of the skate of FIG. 1.

With reference to FIGS. 1 to 7, a roller skate 1 comprises a frame 2 of the extendible kind, comprising a rear half-frame 3 guided slidingly in a longitudinal direction with respect to a forward half-frame 4, by means of a portion 5 of the half-frame 3 being engaged slidingly in a longitudinal seat 6 formed in the half-frame 4 and covered at the top by a plate 7. A locking means is provided for removably securing together the two half-frames 3 and 4, e.g. a bolt 19.

The skate 1 comprises a binding device for securing the foot to the frame 2 at the ankle. That binding device comprises a continuous strap 10 arranged substantially arcuately across the frame 2 and provided with juxtaposed end portions 11, adjustably associated with the frame 2 and intended to undergo a pull force to be applied from a tensioning means.

The tensioning means comprises a slide 13 guided slidingly in the frame 2 in the longitudinal direction of the skate 1; more specifically, the slide 13 is substantially plate-like and movable in a seat 14, formed in the half-frame 3 and covered at the top by a cover plate 15, fastened to the half-frame 3 by a screw 16 passed through an opening 17 in the slide 13. The plate 15 has on the rear two upwardly projecting elevations 18 forming abutment seats for a piece of footwear. The slide 13 is guided, for example, by a lower contour grooved track 8 in engagement with a respective conforming contour track in the seat 14. The slide 13 is connected drivingly, through a drive means, to the end portions 11 for application of the aforesaid pull force thereto, as explained hereinafter.

Laterally of the slide 13, two vertical throughgoing seats 20 are formed in the half-frame 3. The seats 20 are open to the seat 14 and extend from top to bottom throughout the half-frame 3 in an oblique direction upward and forward. Inserted through the seats 20 are the end portions 11 of the strap 10. The throughgoing seats 20 prevent any displacement of the strap 10 in the longitudinal direction.

The aforesaid drive means comprises two cam guides 21 formed laterally on the slide 13, one on each side thereof, and two counter-guides 22 formed on the strap 10, one on each end portion 11. The cam guides 21 and counter-guides 22 are in mutual engagement and so shaped that a forward sliding movement of the slide 13 results in a downward sliding movement of the end portions 11.

More specifically, the cam guides 21 and counter-guides 22 are straight parallel ribs formed on the slide 13 and on the end portions 11 of the strap 10, and are set at an angle to the longitudinal sliding direction of the slide 13. Such ribs are spaced apart from each other by a distance substantially equal to the width of a single rib. The slide 13, moreover, is provided with two depressed side areas 23, flanking the cam guides 21.

The binding device for the skate 1 further comprises means for shifting the slide 13 in the seat 14. Such means comprises a plate-like lever journalled rearward of the half-frame 3 by a horizontal pivot 25. The lever 24 has a T-shaped groove 26 in which a T-shaped head 27 rigid with the slide 13 is engaged slidingly. The lever 24 is provided with locking means wherein a movable hand-grip 28 pulls two pins 31 out of respective seats 29 in the half-frame 3 against springs 30. The two pins 31 are guided slidingly in holes 32 in the lever 24.

With reference now to FIGS. 1 and 9 to 11, at the foot toe end, two horizontal throughgoing seats 34 are formed in the half-frame 4 on either side of the seat 6 and are open to it. End portions 36 of a strap 38 are inserted through the seats 34, each portion 36 being provided with a respective head 39.

The heads 39 of the end portions 36 have respective counter-guides 41 in engagement with corresponding cam guides 43 formed on top of the portion 5 of the half-frame 3. The cam guides 43 and counter-guides 41 are shaped such that a forward sliding movement of the portion 5 (that is, shortening of the skate 1) brings about an inwardly directed sliding movement of the end portions 36 of the strap 38 whereby the strap 38 forms a seat for the foot toe end, which is made wider on extending the skate 1 and vice versa, affording automatic accomodation of different size feet.

The cam guides 43 and counter-guides 41 are similar to the guides 21 and the counter-guides 22, each comprising a plurality of straight parallel ribs, spaced apart by a distance substantially equal to the width of a single rib and being set at an angle to the longitudinal sliding direction of the half-frames 3 and 4 relatively each other.

The skate 1 herein and its foot binding device operate as follows.

With reference to FIG. 2 to 6, a user who intends to put on the skate 1, would lower the lever 24 by acting on the hand-grip 28 to release the pins 31 from the seats 29 and moving the lever 24 thus, the slide 13 is moved to the rear pulled by the T-shaped head 27, the end portions 11 of the strap 10 are caused to slide upwards, and the strap 10 is slackened.

The user will now rest a shod foot on the skate 1, fitting the foot from the rear under the slackened strap 10. The piece of footwear will bear rearwardly against the elevations 18.

On now raising the lever 24 all the way up, the strap 10 is quickly and surely tightened on the foot, this tightened condition being maintained by the pins 31 engaging in the seats 29.

Adjustment of the binding tension is possible when the skate 1 is in slackened condition. The user can lower the lever 24 further down until the counter-guides 22 and the end portions 11 disengage from the cam guides 21 on the slide 13 and locate themselves in front of the depressed areas 23. In this condition, the user can shift the strap 10 by hand as required. Thereafter, the user will again raise the lever 24 partway to restore the engaged condition of the cam guides 21 with the counter-guides 22.

As may be appreciated, a skate according to the invention affords quick binding features in a simple and effortless way by putting the skate on from the rear. While rapidity and simplicity are self-evident features that command no explanations, as regards limitation of the effort involved in the binding process, it should be pointed out that whereas with prior skates the binding tension is to be applied directly to the strap axially thereto, with the inventive skate tension is applied through a convenient lever, with a mechanical advantage (determined by the angle of inclination of the cam guides) which is selected to make the fastening procedure as convenient as feasible.

Furthermore, the rear entrance feature enables the skate to be put on like any sport footwear, with a very simple movement and using one hand.

It should be also noted that with a skate according to the invention, adjustment of the binding tension is not lost on unfastening the skate, thereby the user shall not have to remake it on each occasion.

OTHER MODES FOR CARRYING OUT THE INVENTION

Figure 8:
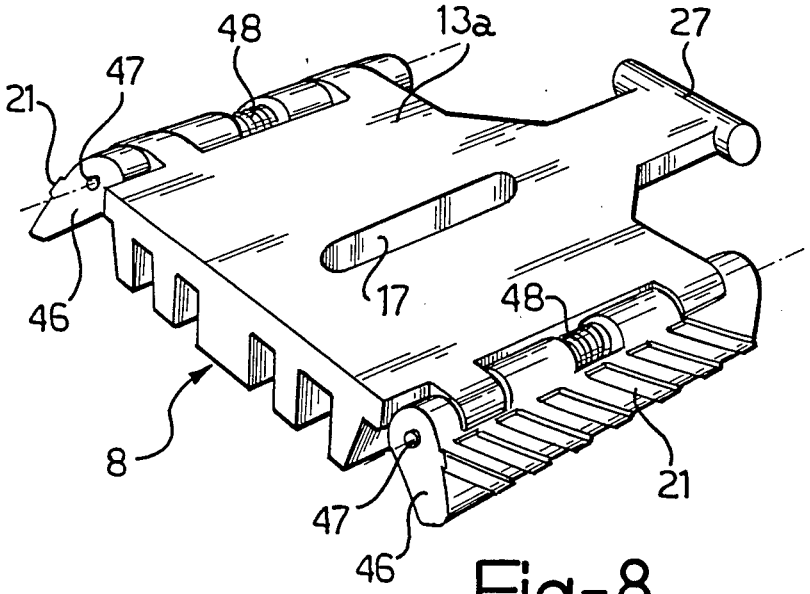
FIG. 8 is a perspective view of a variant embodiment of the detail shown in FIG. 7.
Figure 11:
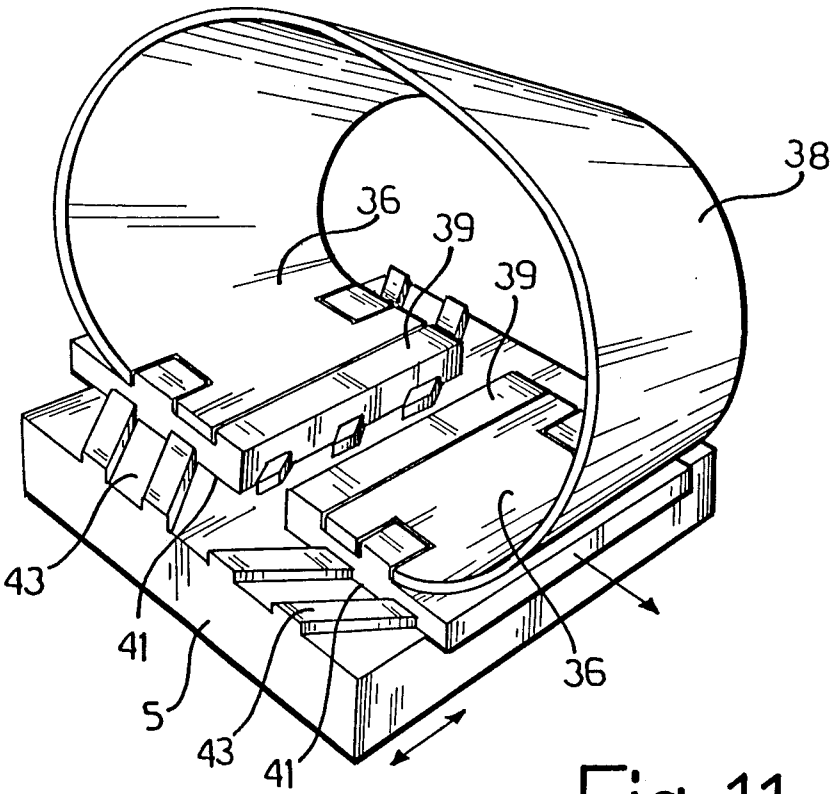
FIG. 11 is a perspective view of a detail of the skate of FIG. 1.

In FIG. 8 a slide **13*a* is shown which is interchangeable with the slide 13; similar parts of the slide 13*a* to the corresponding parts of the slide 13** are designated in the figure with the same numerals, and will not be described.

In the slide **13*a*, the cam guides 21 (again consisting of straight paralles ribs set at an angle) are formed on two wings 46, pivotally attached to the slide 13*a* by horizontal and longitudinal side pivots 47, and urged elastically upwards and outwards by torsion springs 48**.

With the slide **13*a*, adjustment of the binding tension is possible, when the lever 24 is down and the strap 10 is slackened, by pushing the wings 46 by hand and moving the end portions 11 of the strap 10** downwards or upwards.

Figure 12:
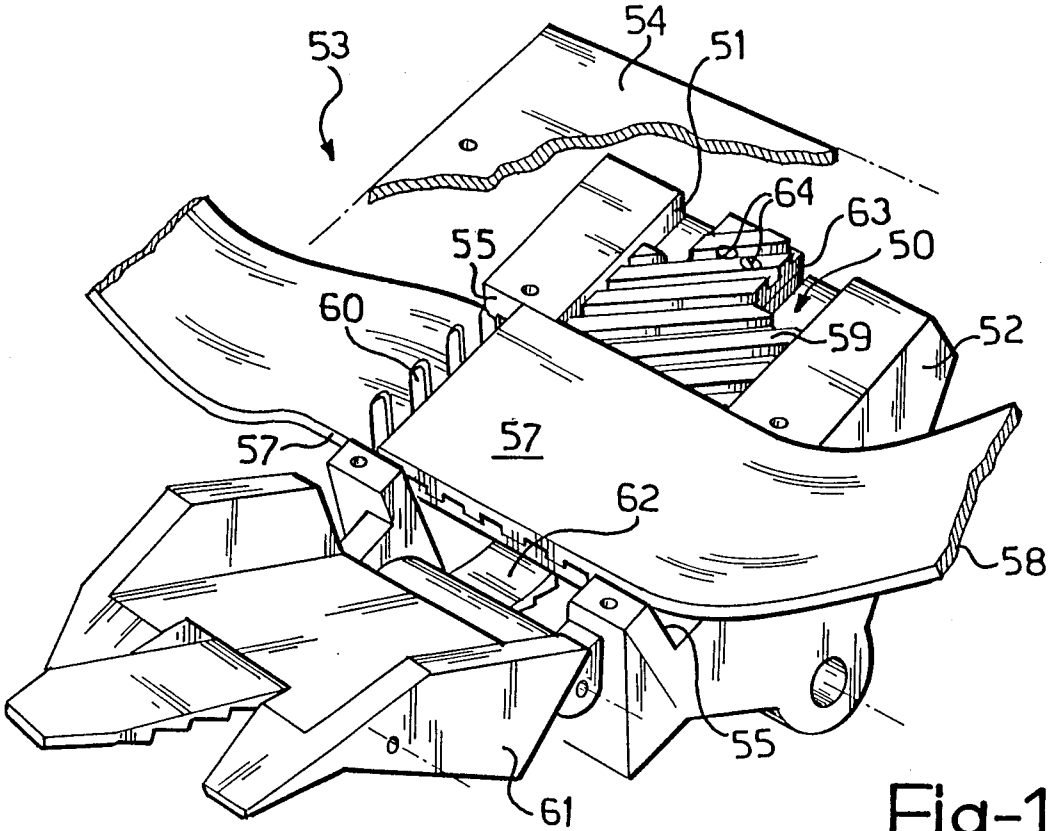
FIG. 12 is a fragmentary exploded perspective view of a variant embodiment of the skate of FIG. 1.
Figure 13:
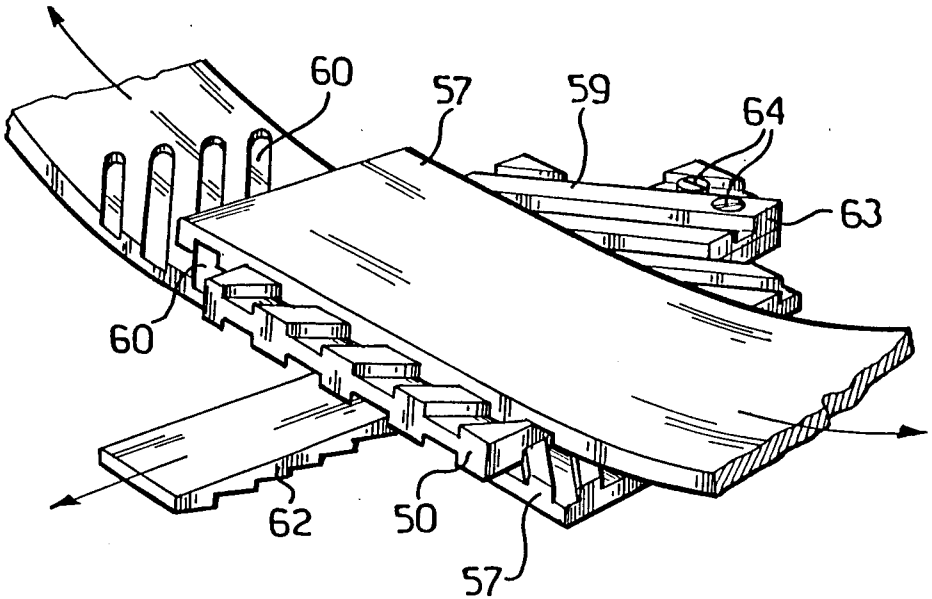
FIG. 13 is a perspective view of a detail of the skate of FIG. 12.

A variant embodiment of the skate 1 is shown in FIGS. 12 and 13. In those figures, a slide 50 is guided slidingly in a longitudinal direction in a seat 51 formed longitudinally in a frame 52 of a roller skate 53 (only partly shown). The seat 51 is covered at the top by a plate 54.

Two throughgoing horizontal seats 55 are formed in the frame 52 laterally of the seat 52, and open to it. Two end portions 57 of a strap 58 are inserted into the seats 55 and engage with the slide 50 in a manner to be explained.

The slide 50 has a plate-like configuration and is provided at the top and bottom with cam guides 59 in engagement with respective counter-guides 60 on the end portions 57 of the strap 58, which sandwich the slide 50 therebetween. The cam guides 59 and counter-guides 60 are shaped such that a forward sliding movement of the slide 50 results in an outward sliding movement of the end portions 57. The cam guides 59 are straight parallel ribs spaced apart by a distance substantially equal to the width of a single rib and set at an angle to the longitudinal sliding direction of the slide 50.

To move the slide 50 to the rear, tightening the strap 58, a rear level 61 is provided which is connected to the slide 50 by a cogged belt 62, attached to a forward tip 63 of the slide 50 by means of rivets 64 and being passed below the slide 50 and the end portions 57 of the strap 58. The cogged belt 62 is attached adjustably to the lever 61 by means of a conventional device (not shown), e.g. of the tightening variety.

The operation of the skate 53 is quite similar to that of the skate 1 whereby the binding tension is adjusted by shifting the cogged belt 62 relatively to the lever 61.

It should be noted that all the cam guides and respective counter-guides may take different forms from the ribs herein described and illustrated. For example, in a particularly simple embodiment (not shown) the counter-guides may be pegs engaging in guides in the form of grooves.

Figure 15:
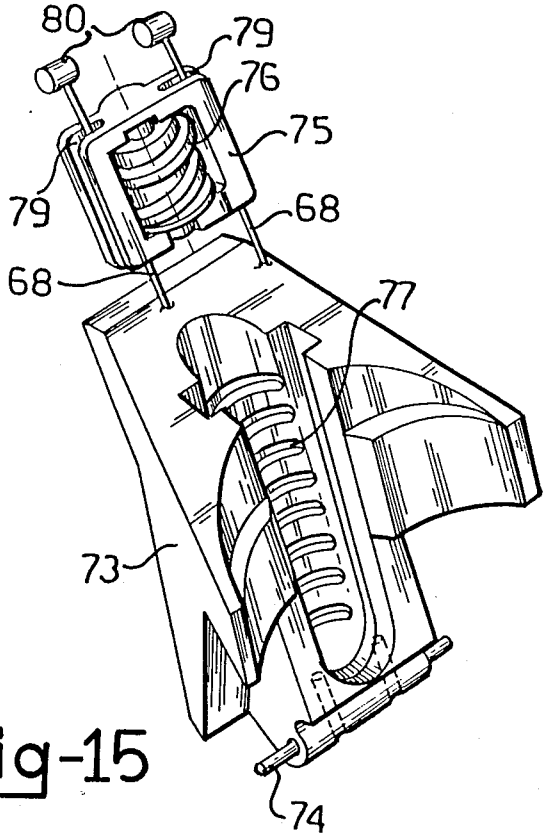
FIG. 15 is an exploded perspective view of a detail of the skate of FIG. 14.
Figure 14:
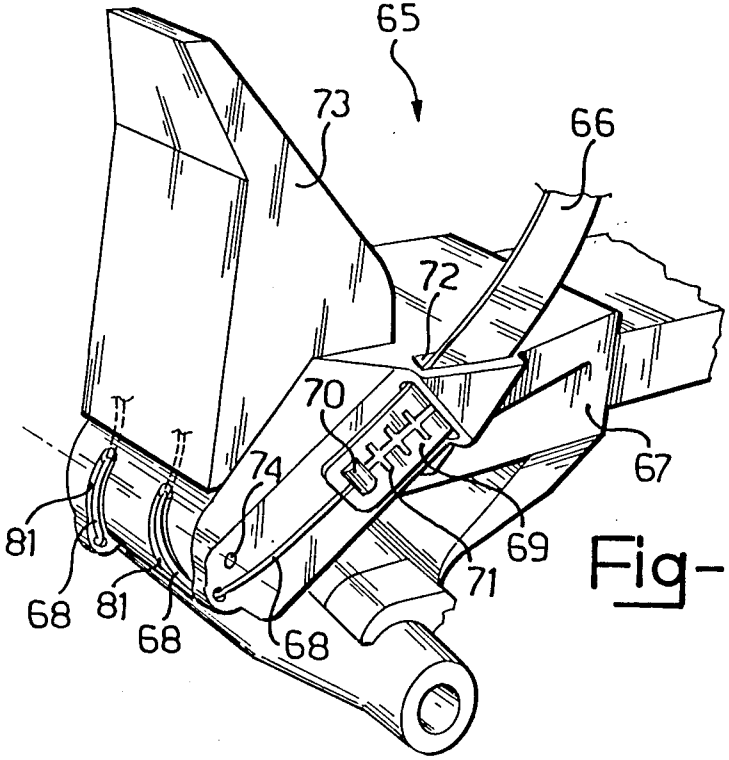
FIG. 14 is a fragmentary perspective view of a further variant embodiment of the skate of FIG. 1.
Figure 16:
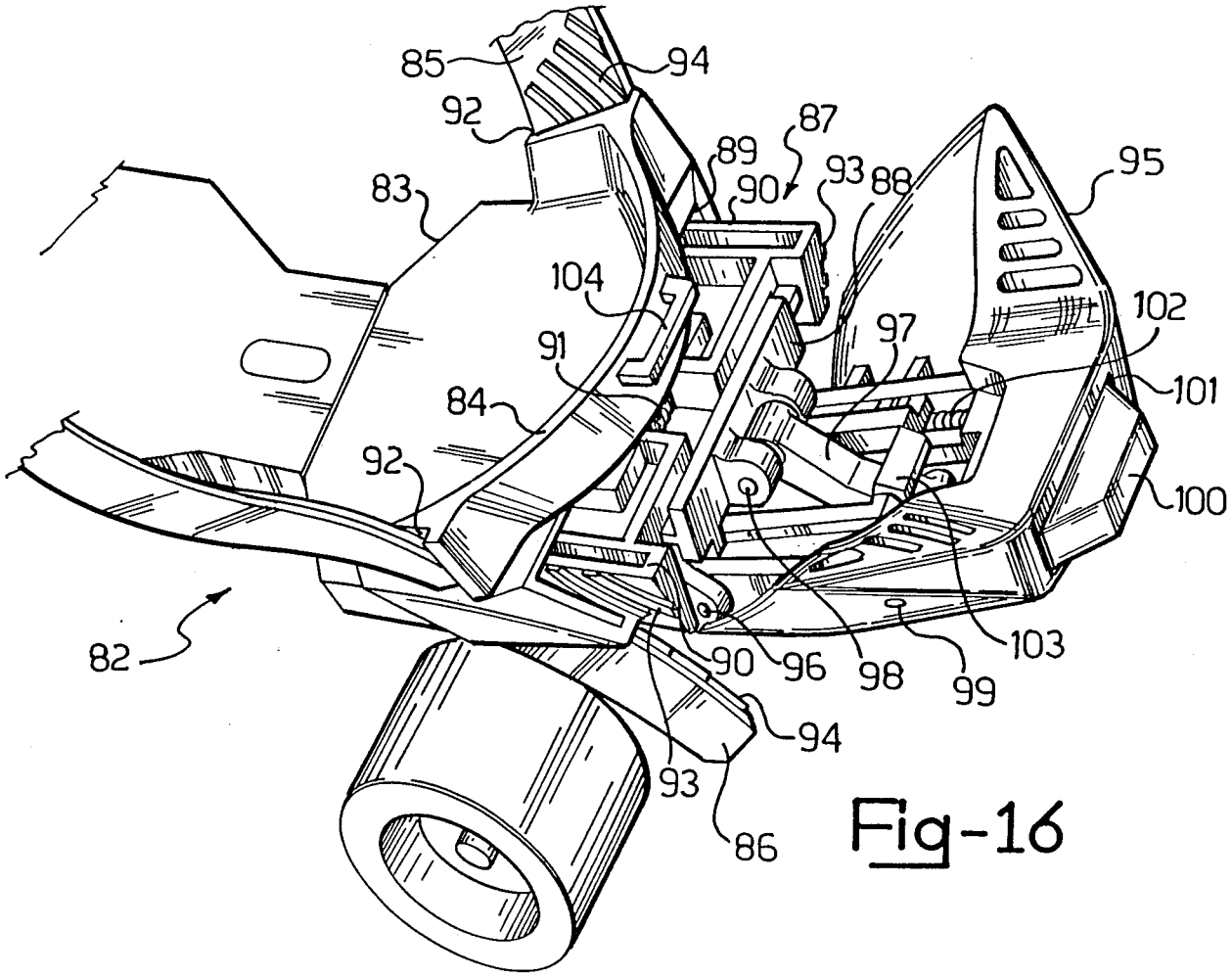
FIG. 16 is a fragmentary perspective view of a further variant embodiment of the skate of FIG. 1.
Figure 17:
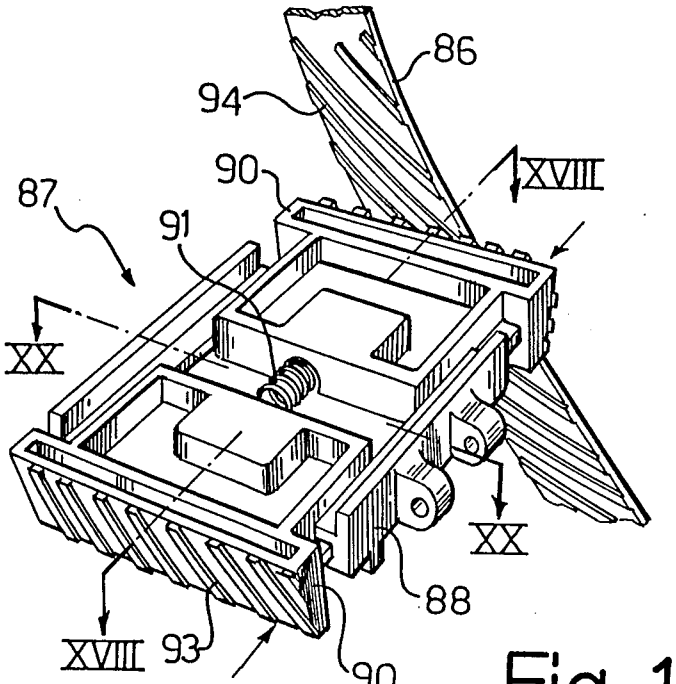
FIG. 17 is a perspective view of a detail of the skate of FIG. 16.
Figure 18:
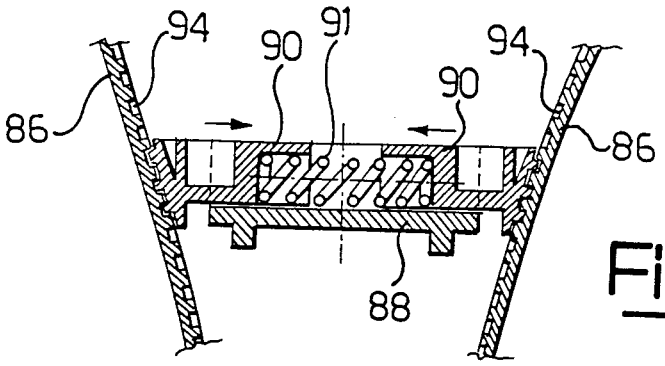
FIG. 18 is a sectional view of the detail of FIG. 17, taken along line XXVIII—XVIII.
Figure 19:
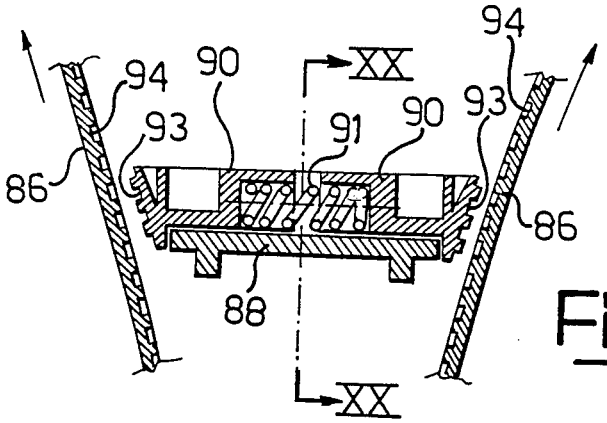
FIG. 19 is a sectional view corresponding to that of FIG. 18, in a different conditions.
Figure 20:
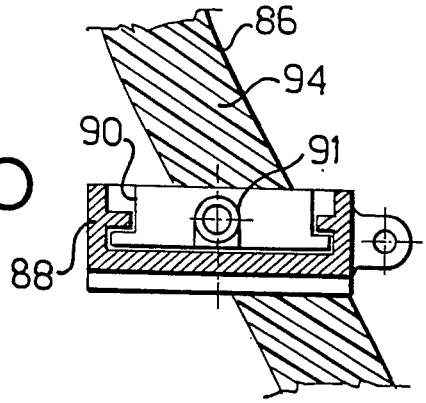
FIG. 20 is a sectional view of the detail of FIGS. 18 and 19, taken along line XX—XX.

In conformity with a further variant embodiment, in FIGS. 14 and 15 a skate 65 is partly shown wherein the tensioning means for a strap 66 on a frame 67 comprises two cable lengths 68 anchored on end portions 69 of the strap 66 by means of respective enlarged terminals 70, attached to the cables 68 and being held in respective slots 71 formed in the end portions 69. Advantageously, each end portion 69 has several slots 71, for improved adjustment.

The end portions 69 of the strap 66 are inserted into two respective throughgoing seats 72, formed in the frame 67 and extending through it in an oblique direction upwards and forward.

The skate 65 further comprises a means of pulling the cables 68, which means comprises a lever 73 carried pivotally rearwards of the frame 67 by a horizontal pivot 74. In the lever 73 (configured as a heel piece) there is guided longitudinally a slider 75 having a means of anchoring the lever 73 adjustably, such as a screw 76 carried rotatably on the slider 75 and engaging with a rack 77 formed on the lever 73.

Anchored on the slider 75 are the cables 68, being passed through side slots 79 and held by enlarged terminals 80. The cables 68 extend longitudinally to the lever 73 and are trained around shaped grooves 81 having deflector functions.

The lever 73 is also provided with a lock device, of a conventional type, not shown in the figures.

The operation of the skate 65 can be taken directly from the preceding description. To fit the skate on, the user should lower the lever 73, fit the foot on the frame 67, below the strap 66, and raise the lever 73 back up tightening the strap 66 onto the foot instep, against the heel piece formed by the lever 75 itself.

A further embodiment of the invention is shown in FIGS. 16 to 20. A skate 82 comprises a frame 83 provided on the rear with an upwardly projecting elevation 84 forming abutment seat for a piece of footwear on the frame 83.

The skate 82 comprises a binding device for securing the foot to the frame 83 at the ankle. That binding device comprises a strap 85, arranged substantially arcuately across the frame 83 and provided with juxtaposed end portions 86, adjustably associated with the frame 83 and intended to undergo a pull force to be applied from a tensioning means.

The tensioning means comprises a slide 87 guided slidingly in the frame 83 in a longitudinal direction to the skate 82 and drivingly connected to the end portions 86 of the strap 85 through a drive means, as explained hereinafter.

The slide 87 comprises a slide carriage 88, slidable in a seat 89 formed within the frame 83, and two slide wings 90; each slide wing 90 is transversally guided on the slide carriage 88 and a spring 81, compressed between the two slide wings 90, biases the slide wings 90 outwards, one apart from the other.

Laterally of the slide 87, two vertical throughgoing seats 92 are formed in the frame 83; the seats 92 are open to the seat 89 and extend from top to botton throughout the frame 83 in an oblique direction upward and forward. Inserted through the seats 92 are the end portions 86 of the strap 85. The throughgoing seats 92 prevent any displacement of the strap 85 in the longitudinal direction.

The aforesaid drive means comprises two cam guides 93, each formed on a respective slide wing 90, and two counter-guides 94 formed on the strap 85, one on each end portion 86. The cam guides 93 and counter-guides 94 are in mutual engagement and so shaped that a forward sliding movement of the slide 87 results in a downward sliding movement of the end portions 86.

Like in the skake 1, the cam guides 93 and the counter-guides 94 are straight parallel ribs formed on the slide wings 90 and the end portions 86 of the strap 85, and are set at an angle to the longitudinal sliding direction of the slide 87. Such ribs are spaced apart from each other by a distance substantially equal to the width of the single rib.

Means of shifting the slide 87 in the seat 89 are provided, which means comprises a lever 95 journalled rearward of the frame 83 by a horizontal pivot 96, and a connecting rod 97 journalled to the slide carriage 88 and to the lever 95 by respective horizontal pivots 98 and 99. The lever 95 is provided with locking means wherein a push member 100, slidable in a seat 101 in the lever 95 against springs 102, has a hook 103 in a removable engagement with an eye 104 formed on the back of the upwardly projecting elevation 84 of the frame 83.

The skate 82 and its foot binding device operate as follows.

With reference to FIGS. 16 to 20, a user who intends to put on the skate 82, would lower the lever 95 by pushing the push member 100 to release the hook 103 from the eye 104. Thus, the slide 87 is moved to the rear, the end portions 86 of the strap 85 are caused to slide upwards, and the strap 85 is slackened.

The user will rest a shod foot on the skate 82 fitting the foot from the rear under the slackened strap 85. The piece of footwear will bear rearwardly against the elevation 84.

On now raising the lever 95 all the way up, the strap 85 is surely tightened on the foot, this tightened condition being maintained by the hook 103 engaging the eye 104.

Adjustment of the binding tension is possible, when the skate 82 is in slackened condition, by pushing the slide wings 90 by hand and moving the end portions 86 of the strap 85 upwards or downwards.

What is claimed is:

1. A roller skate with a binding device for releasably securing a shod foot to a skate frame comprising:

slide means movable guided on said frame for sliding movement in a longitudinal direction thereof, a strap disposed arcuately across said frame with the end portions thereof disposed adjacent said slide means on opposite sides thereof, respectively, guide means on said frame for engaging said strap to prevent displacement of the strap ends in said longitudinal direction, tensioning means for applying a reversible force to said strap ends for moving said strap into an out of a tensioned engagement with a shod foot and releasable locking means for maintaining the tensioned engagement of said strap with a shod foot, said tensioning means including at least one cam guide formed on said slide means and at least one counter guide complementary to said cam guide formed on at least one strap end in engagement with said at least one cam guide.

2. A skate according to claim 1, wherein two cam guides and two counter-guides are provided, respectively one for each strap end portion.

3. A skate according to claim 2, wherein said cam guides are formed laterally on said slide, one on either side thereof.

4. A skate according to claim 2, characterized in that said cam guides are both formed upwardly on said slide.

5. A skate according to claim 2, wherein said cam guides are formed with facing one upwardly and the other facing downwardly on said slide.

6. A skate according to claim 2, wherein said cam guides are formed on wings attached pivotally to the sides of the slide and a urged elastically upwards and outwards.

7. A skate according to claim 2, wherein said cam guides are formed on slide wings, transversally guided on the slide and being urged elastically outwards.

8. A skate according to claim 1, wherein said cam guides and said counter-guides are straight parallel ribs set at an angle to said longitudinal direction.

9. A skate according to claim 1, wherein said means of preventing displacement of the strap in the longitudinal direction comprises throughgoing seats formed in the frame for said strap end portions.

10. A skate according to claim 1, wherein said slide means further comprises a means of shifting the slide in the longitudinal direction.

11. A skate according to claim 10, wherein said means of shifting the slide in the longitudinal direction comprises a lever carried pivotally on the frame and a hammer-head rigid with said slide and engaged slidingly in a corresponding T-shaped groove in the lever.

12. A skate according to claim 10, wherein said means of shifting the slide in the longitudinal direction comprises a lever carried pivotally on the frame and a connecting rod, journalled to the slide and to the lever.

13. A skate according to claim 10, wherein said means of shifting the slide in the longitudinal direction comprises a lever carried pivotally on the frame and a cogged belt rigid with the slide and attached adjustably to the lever.

14. A skate according to claim 11, wherein said releasable locking means comprises a movable handgrip, pins connected to the handgrip and guided slidingly in holes in the lever and holes in the frame with the handgrip being capable of pulling the pins out of the holes in the frame.

15. A skate according to claim 12, wherein said releasable locking means comprises a hook in removable engagement with an eye on the frame, the hook being formed on a push member slidable in a seat in the lever against springs.

* * * * *